US006345696B1

(12) United States Patent
Yumura

(10) Patent No.: US 6,345,696 B1
(45) Date of Patent: Feb. 12, 2002

(54) ELEVATOR SPEED GOVERNOR

(75) Inventor: Takashi Yumura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/697,476

(22) Filed: Oct. 27, 2000

(51) Int. Cl.[7] ..... B66B 5/06
(52) U.S. Cl. ..... 187/287; 187/373
(58) Field of Search ..... 187/277, 286, 187/287, 373, 391, 393, 399; 188/182, 181, 185, 187; 73/862.12, 862.17, 862.331, 862.333, 862.335, 862.339; 324/207.13, 207.15, 207.25

(56) References Cited

U.S. PATENT DOCUMENTS 3,802,274 A * 4/1974 Berkovitz ..... 73/497
4,531,617 A * 7/1985 Martin et al. ..... 187/89
4,662,481 A * 5/1987 Morris et al. ..... 187/77
5,065,845 A * 11/1991 Pearson ..... 187/89
5,301,773 A 4/1994 Jamieson et al.
5,366,044 A 11/1994 Jamieson et al.
5,458,216 A * 10/1995 Tanaka et al. ..... 187/373
5,628,385 A 5/1997 Yumura et al.
5,653,312 A * 8/1997 Kato ..... 187/350
6,003,636 A 12/1999 Yumura
6,109,398 A * 8/2000 Lempio et al. ..... 188/181
6,138,799 A * 10/2000 Schroder-Brumloop et al. . 187/452

* cited by examiner

*Primary Examiner*—Jonathan Salata
(74) *Attorney, Agent, or Firm*—Leydig, Voit, & Mayer, Ltd.

(57) ABSTRACT

An elevator speed governor includes a motion converter for converting a traveling speed of a traveling section of an elevator into a rotational speed; an overspeed sensor for sensing a rotational speed not less than a predetermined speed; and an overspeed detector for detecting an overspeed of the traveling section to stop the traveling section, wherein the motion converter includes permanent magnets supported by a rotating shaft of the motion converter so that the magnets rotate with the rotating shaft. An eddy current is generated according to the traveling speed in an electric induction conductor arranged in a traveling direction of the traveling section of the elevator. A rotational torque is generated in the rotating shaft by interaction between the eddy current and the magnetic flux produced by the permanent magnets.

14 Claims, 10 Drawing Sheets

A-A
CROSS-SECTION

B-B
CROSS-SECTION

ELEVATOR SPEED GOVERNOR

BACKGROUND OF THE INVENTION

1. Field of the Invention

The present invention relates to an elevator speed governor located on an elevator cage to detect overspeed of the elevator cage.

2. Description of the Related Art

Japanese Unexamined Patent Publication No. 5-147852 discloses an elevator speed governor, which is composed as follows. There is provided a link oscillating around a fulcrum provided on an elevator cage. A pair of permanent magnets has between them an induction conductor arranged in the hoistway in the elevating direction of the cage. The magnets and a back yoke are attached to one end of the link, and a balance weight, which is balanced with the moment of the permanent magnet and yoke, is attached to the other end of the link. An electromagnetic force is generated by an interaction between an eddy current, which is caused in an induction conductor by the magnetic flux of the permanent magnet according to the traveling of the cage, and the magnetic flux. The link is tilted by this electromagnetic force. By this tilt of the link, overspeed of the cage is detected.

Also, Japanese Unexamined Patent Publication No. 4-246079 discloses an elevator speed governor composed as follows. There is provided a roller which is pressed against a guide rail arranged in the hoistway in the elevating direction of the cage. When the cage is elevated, a rotary disc is rotated, and the overspeed of the cage is detected by displacement of a fly-weight attached to this rotary disc.

The conventional elevator is composed as described above. However, the following problems may be encountered in the conventional elevator. The electromagnetic force generated between the eddy current created in the induction conductor and the magnetic flux depends upon the electrical conductivity and magnetic permeability of the induction conductor. Therefore, errors are caused in the detection of the overspeed, for example, by the fluctuation of temperature. In the case where the guide rail is also used as an induction conductor, it is impossible to guarantee that the magnetic characteristic of the guide rail will be uniform, and the detecting motion fluctuates due to the fluctuation of the magnetic characteristic of the guide rail. In the case of detecting the overspeed by displacement of a fly-weight caused by a centrifugal force acting on the fly-weight arranged on the rotary the inertia of the rotational section is high, so that the response becomes slow. Further, when the cage speed is slow, intensity of the centrifugal force is low, and it impossible to detect the cage speed stably. Furthermore, slippage of the detecting roller may be caused by step portions at the connecting sections of the guide rails. Therefore, it is impossible to detect the overspeed stably.

SUMMARY OF THE INVENTION

The present invention has been accomplished to solve the above problems of the prior art. It is an object of the present invention to provide an elevator speed governor in which no change is caused in the detection of the overspeed by the fluctuation of the electromagnetic characteristic of an induction conductor and also by the fluctuation of temperature; and the overspeed can be stably detected even in the case of low cage speed.

The present invention provides an elevator speed governor comprising: a motion converting means for converting a traveling speed of a traveling section of an elevator into a rotational speed, the motion converting means being mounted on the traveling section of the elevator; an overspeed sensing means for sensing a rotational speed not less than a predetermined speed of the motion converting means; and an overspeed detecting means for detecting an overspeed of the traveling section so as to stop the traveling section, wherein the motion converting means includes permanent magnets supported by a rotational shaft of the motion converting means so that the magnets can be rotated integrally with the rotational shaft, and an eddy current is generated according to the traveling speed in an electric induction conductor, which is arranged in a traveling direction of the traveling section of the elevator, by an action of electromagnetic induction caused by the magnetic flux of the permanent magnets, so that a rotational torque is generated in the rotational shaft by the interaction between the eddy current and the magnetic flux.

The induction conductor is a guide rail arranged in the traveling passage.

The overspeed sensing means includes a fly-weight rotated integrally with the rotational shaft and displaced relatively to the rotational shaft by centrifugal forces created by the rotation of the rotational shaft.

The fly-weight supports the permanent magnets and composes a portion of the motion converting means.

The overspeed sensing means includes an oscillator sensing a change of a spatial distribution of the magnetic flux caused by the rotation of the motion converting means and oscillating by an amplitude according to the rotational speed.

The overspeed sensing means includes a power generating means for sensing a change of a spatial distribution of the magnetic flux caused by the rotation of the motion converting means and generating electric power according to the rotational speed.

The motion converting means includes a roller coming into contact with a guide rail arranged in the traveling passage and rotating according to the traveling speed.

DETAILED DESCRIPTION OF THE PRESENT INVENTION

Embodiment 1

Figure 1A:
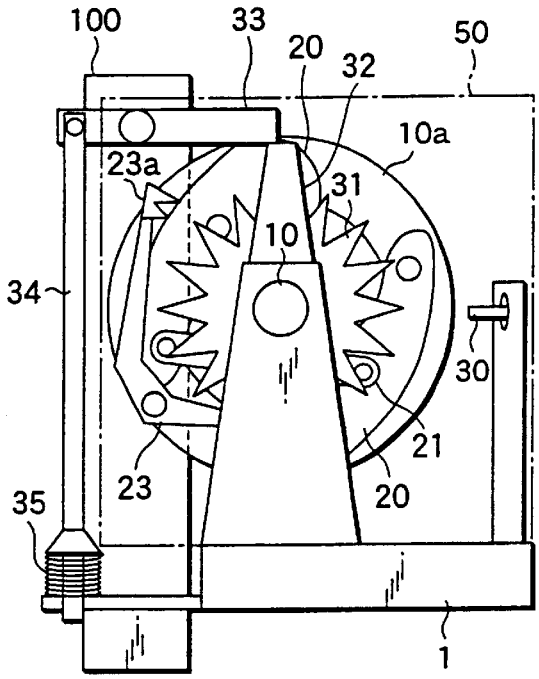
FIGS. 1A and 1B represent a front view and a side view of an elevator speed governor of the first embodiment of the present invention, respectively.

Referring to the appended drawings, an elevator speed governor of the present invention will be explained below. In this connection, like reference characters are used to indicate like parts in the embodiments described as follows.

Figure 1B:
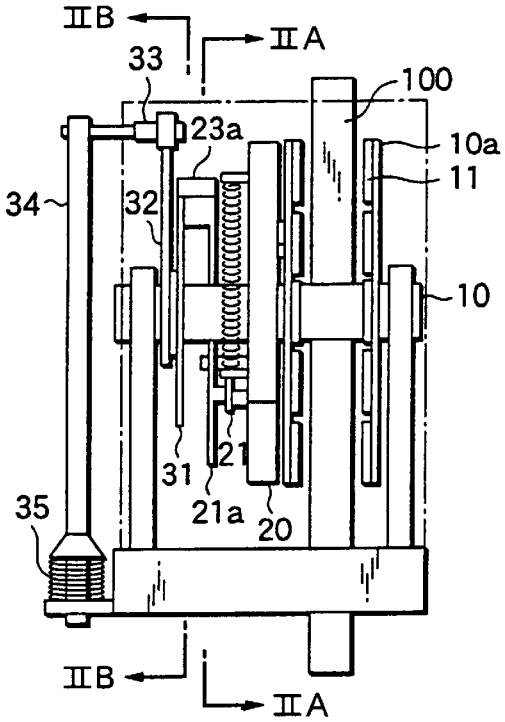
Figure 2A:
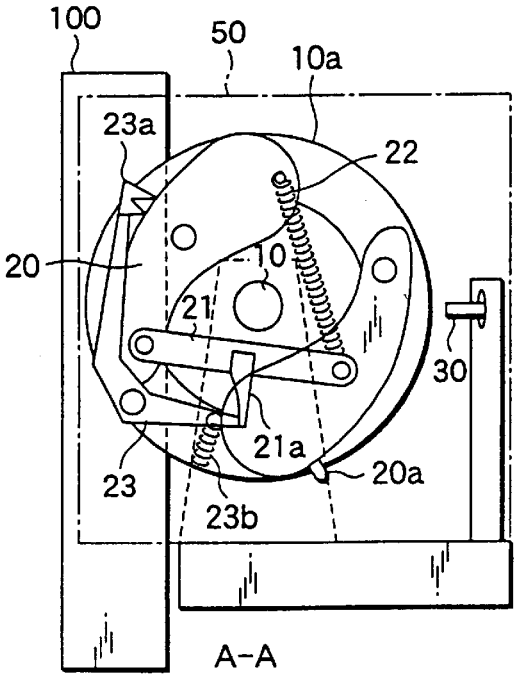
FIGS. 2A and 2B represent cross-sectional views taken on lines IIA—IIA and IIB—IIB in FIG. 1B, respectively.
Figure 2B:
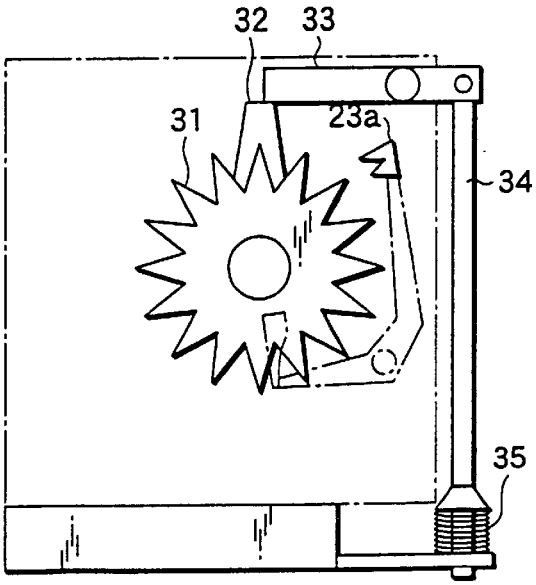
Figure 3:
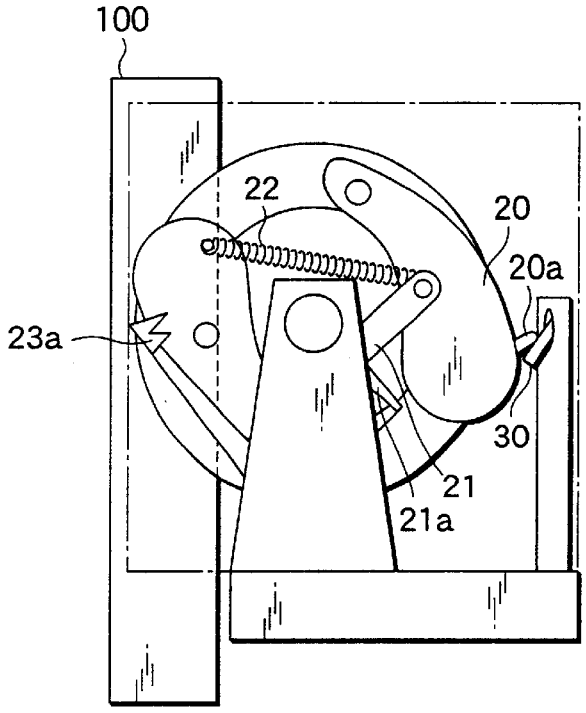
FIG. 3 is a view showing a state in which the first overspeed of a cage is detected.
Figure 4A:
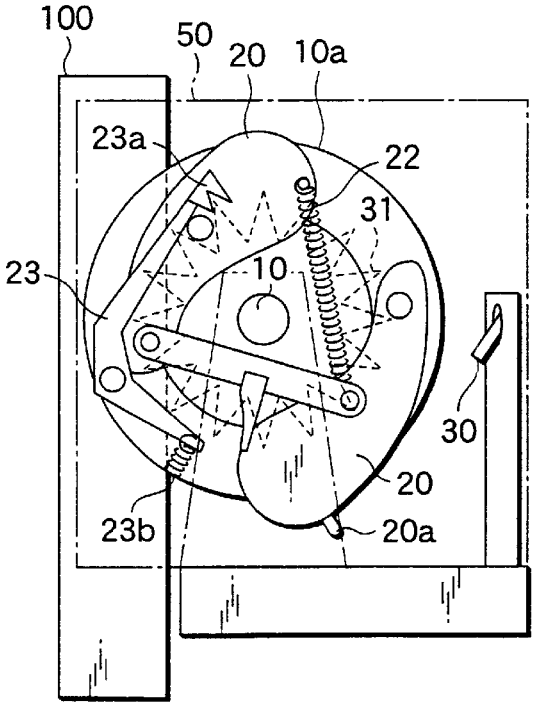
FIGS. 4A and 4B are views each showing a state in which the second overspeed of a cage is detected.
Figure 4B:
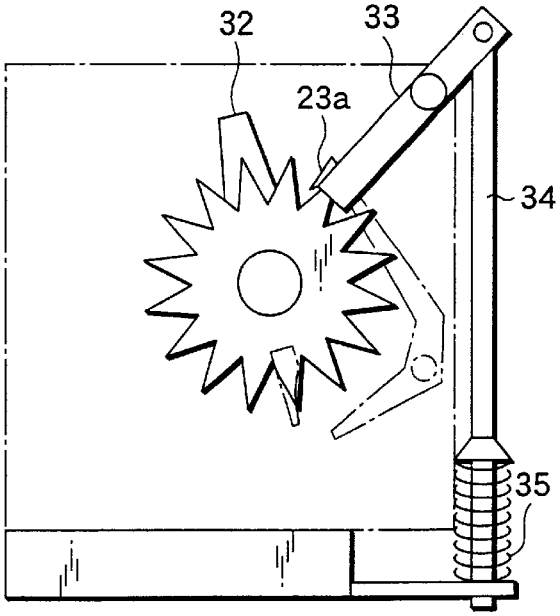

FIGS. 1A and 1B represent a front view and a side view of an elevator speed governor of the first embodiment of the present invention, respectively. FIGS. 2A and 2B represent cross-sectional views respectively taken on lines IIA—IIA and IIB—IIB in FIGS. 1A and 1B. FIG. 3 is a view showing a state in which the first overspeed of a cage is detected. FIGS. 4A and 4B are views showing a state in which the second overspeed of a cage which is higher than the first overspeed of a cage is detected.

This elevator speed governor includes: a motion converting section for converting a cage speed into a rotational speed, mounted on the cage and rotated by the principle of Arago's Rotating Disc; an overspeed sensing section for sensing an overspeed when the motion converting section has reached a predetermined rotational speed; and an overspeed detecting section for detecting an overspeed when the overspeed sensing section has sensed the overspeed. In this case, "the motion converting section", "the overspeed sensing section" and "the overspeed detecting section" are defined as section which are provided when the composition of the elevator speed governor of the present invention is functionally divided. Therefore, it should be noted that those section do not exist independently from each other.

The motion converting section includes: a rotational shaft 10 supported by the base 1 fixed to the cage; a disc type back yoke 10*a*, which is a pair of ferromagnetic bodies, fixed to the rotational shaft 10, arranged in such a manner that the sides of the back yoke adjacent to the induction conductor 100 arranged in the hoistway are opposed to both sides of the induction conductor 100; and a plurality of trapezoidal or sector-shaped permanent magnets 11 which are fixed onto both sides of the disc-shaped back yoke 10*a* at substantially regular intervals being opposed to the induction conductor 100, wherein one magnetic pole face is fixed to the back yoke 10*a* and the other magnetic pole face is opposed to the side of the induction conductor 100 via a gap so that two adjacent magnets can be set in a reverse polarity state. Therefore, when the cage is elevated, a rotational torque is created in the motion converting section by an interaction between the magnetic flux of the permanent magnet 11 and the eddy current created in the induction conductor 100 by the magnetic flux, so that the motion converting section is rotated according to the cage traveling speed.

The overspeed sensing section includes: a pair of fly-weights 20 attached to one disc type back yoke 10*a* being opposed to each other with respect to the shaft 10, the fly-weights being displaced in the radial direction; a switch operation pin 20*a* fixed to one fly-weight 20 close to the outer circumference of the back yoke 10*a*; a connecting rod 21 provided with the claw 21*a* which is arranged so that the fly-weights 20 can be moved in the same direction when centrifugal forces act on the fly-weights 20; a pushing spring 22 for restricting the displacements of the fly-weights 20 until the rotational speed of the rotational shaft 10 is increased to a value corresponding to the first cage overspeed; a first latch 23 attached to the disc type back yoke 10*a* on the fly-weight 20 side, rotation of the first latch 23 being restricted when the first end portion of the first latch 23 is engaged with the claw 21*a* until the rotational speed of the rotational shaft 10 is increased to a value corresponding to the second cage overspeed; and a pushing spring 23*a* for giving a predetermined torque to the first latch 23.

The overspeed detecting section includes: a stop switch 30 with which the switch operation pin 20*a* comes into contact when the fly-weight 20 is displaced to a predetermined first displacement; a second latch 31 pivotally attached to the rotational shaft 10 so that the second latch 31 can be engaged with the engaging claw 23*a* provided in the second end portion when the fly-weight 20 is displaced to a predetermined second displacement, which is larger than the first displacement and when the engagement with the claw 21*a* of the first latch 23 is released; a cam 32 rotated integrally with the second latch 31; and a connecting lever 33 pivotally attached to the cover 50 at the center, pivotally attached to one end of the connecting rod 34 which is a portion of the emergency stop device provided in the cage, the connecting lever 33 being engaged with the cam 32 and restricting a raise of the connecting rod 34 conducted by the lifting spring 35. When the first cage overspeed is detected, the power source of the elevator drive unit is shut off by the operation of the stop switch 30. When the speed exceeds the second cage overspeed, the cam 32 and the connecting lever 33 are disengaged from each other, and the connecting rod 34 is raised by the lifting spring 35, so that the emergency stop device is operated and the cage is stopped.

When the elevator speed governor is composed as described above, it is unnecessary to detect the cage speed in such a manner that the roller is pressed against the guide rail arranged in the hoistway. Therefore, no abrasion is caused in the speed detection. Accordingly, it is possible for the elevator speed governor to be operated highly reliably over a long period of time. In this connection, the induction conductor 100 may be made of electric conductive material such as copper. Alternatively, the guide rail made of steel may be also used as the induction conductor 100.

In the embodiment explained above, the fly-weights are attached to the disc type back yoke. However, it is possible to adopt an arrangement in which a portion of the disc type back yoke is also used as the fly-weight.

According to the above arrangement, moment of inertia of the rotational section can be reduced. Therefore, the rotational section can highly accurately follow the change in the cage speed.

Figure 5:
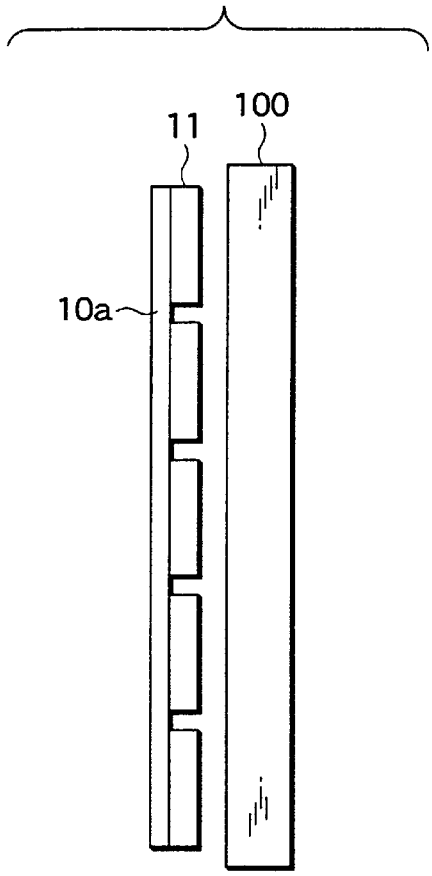
FIG. 5 is a schematic illustration for explaining a variation of the motion converting section used for the arrangement shown in FIGS. 1A and 1B.

In the above explanation, the motion converting section includes: a disc type back yoke which is a pair of ferromagnetic bodies arranged in such a manner that the sides of the back yoke adjacent to the induction conductor are opposed to both sides of the induction conductor; and a plurality of sector-shaped or trapezoidal permanent magnets fixed to the two sides of the yoke opposed to the induced conductor at substantially regular intervals. As a relation with the induction conductor is shown in FIG. 5, it is possible to adopt an embodiment in which a single back yoke is arranged being opposed to the induction conductor, and the permanent magnets are fixed to the side of the back yoke on the induction conductor side.

In the above embodiment, the plurality of permanent magnets fixed to the disc type back yoke are respectively formed into sector-shapes and arranged at regular intervals so that the polarities of the two adjacent magnets can be reverse to each other. However, it should be noted that the arrangement of the permanent magnets, in which the polarities of the two adjacent magnets are reverse to each other, is not a necessary condition. As long as the motion converting section can be given an effective rotational torque according to the positional relation between the magnetic field and the induction conductor, any embodiment can be adopted. FIGS. 6, 7A, 7B, 8A 8B, 9 10 and 11 are views showing examples of the effective arrangement pattern of the permanent magnets and also showing a method by which the fluctuating rotary torque is compensated.

Figure 6:
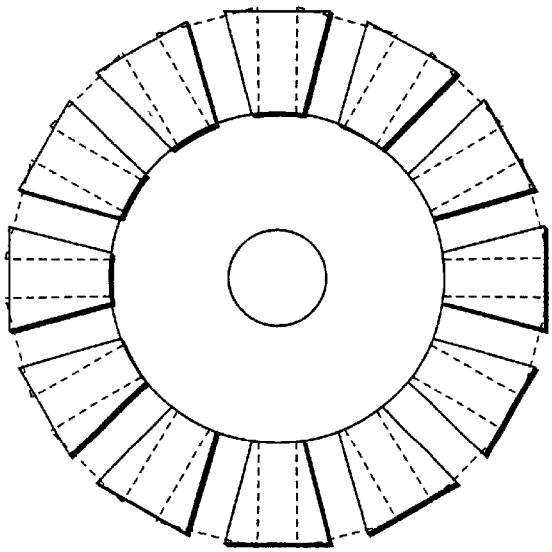
FIG. 6 is a schematic illustration for explaining a variation of the arrangement of permanent magnets of the motion converting section used for the arrangement shown in FIGS. 1A and 1B.
Figure 7A:
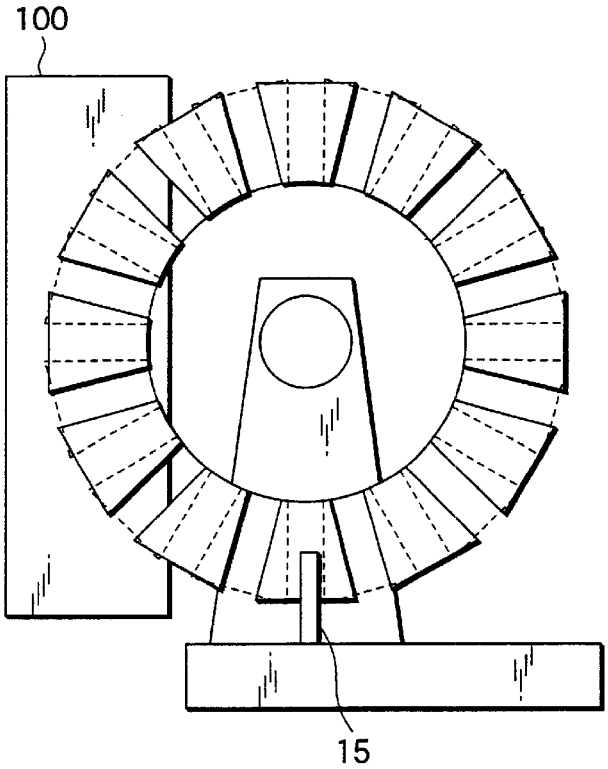
FIGS. 7A and 7B are views for explaining a method of suppressing a change in the rotational torque of the motion converting section used for the arrangement shown in FIGS. 1A and 1B.
Figure 7B:
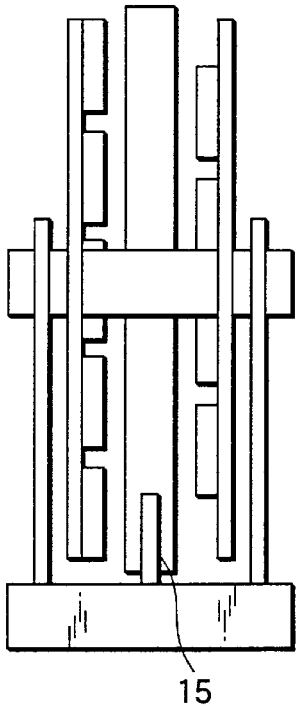

FIG. 6 is a view showing an arrangement which is effective when ferromagnetic bodies are used for the induction conductors. In this arrangement, permanent magnets are arranged on two disc type back yokes in such a manner that phases of the magnets are shifted from each other. FIGS. 7A and 7B are views each showing an arrangement which is effective to compensate the fluctuation of rotational torque acting on the motion converting section when it is applied to the motion converting section shown in FIG. 6. In this arrangement, there is provided a torque compensation piece 15, which is made of a conductor or a ferromagnetic body, fixed onto the base 1. A magnetic attraction force generated by the magnetic field of the permanent magnet 11 and/or an electromagnetic force generated by the interaction with an eddy current compensates a change in the rotary torque acting on the motion converting section.

Figure 8A:
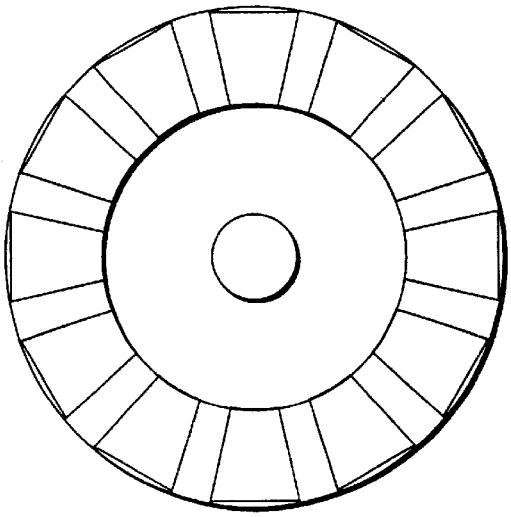
FIGS. 8A and 8B are schematic illustrations each for explaining another variation of the arrangement of permanent magnets of the motion converting section used for the arrangement shown in FIGS. 1A and 1B.
Figure 8B:
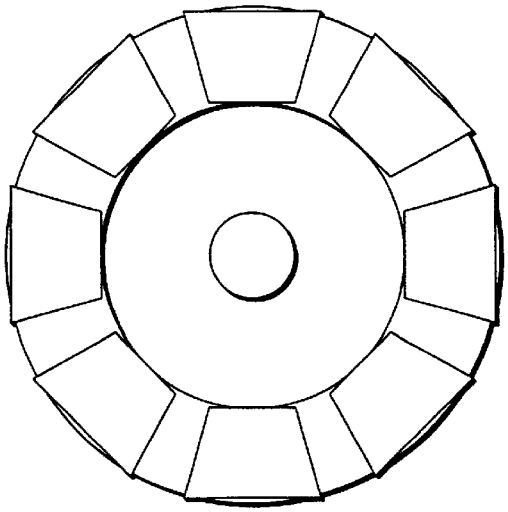
Figure 9:
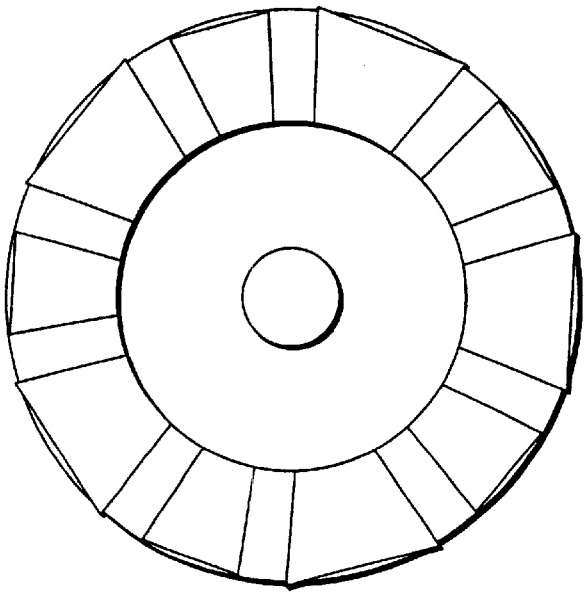
FIG. 9 is a schematic illustration for explaining still another variation of the arrangement of permanent magnets of the motion converting section used for the arrangement shown in FIGS. 1A and 1B.
Figure 10:
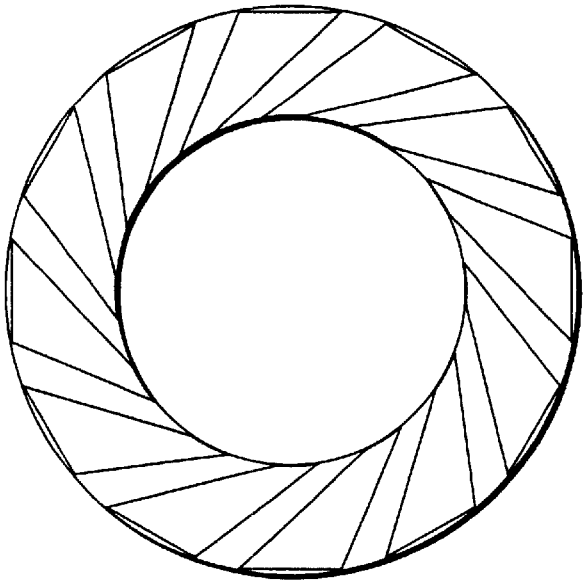
FIG. 10 is a schematic illustration for explaining still another variation of the arrangement of permanent magnets of the motion converting section used for the arrangement shown in FIGS. 1A and 1B.
Figure 11:
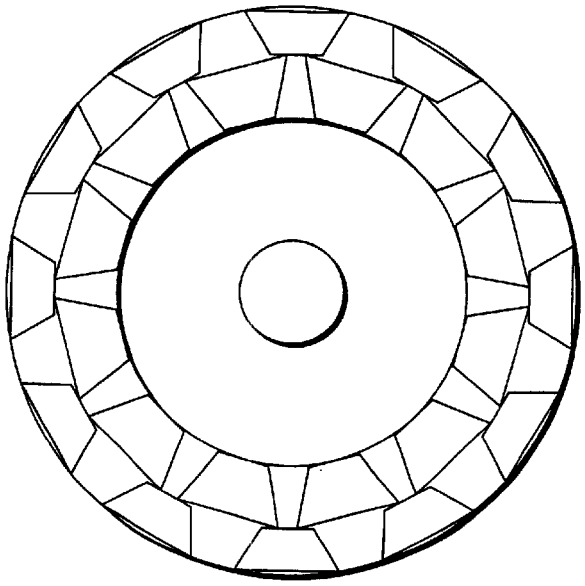
FIG. 11 is a schematic illustration for explaining still another variation of the arrangement of permanent magnets of the motion converting section used for the arrangement shown in FIGS. 1A and 1B.

FIGS. 8A and 8B are views showing an arrangement in which permanent magnets, the sizes and numbers of which are different from each other, are respectively arranged in the two disc type back yokes, respectively. FIG. 9 is a view showing an arrangement in which permanent magnets, the sizes of which are different from each other, are arranged. FIG. 10 is a view showing an arrangement in which permanent magnets are arranged, wherein the profile of each permanent magnet is a quadrilateral having two sides crossing the radial direction of the disc type back yoke by a large angle. FIG. 11 is a view showing an arrangement in which permanent magnets are arranged on two circumferences, the radiuses of which are different from each other, while the phases of the magnets are shifted from each other. This arrangement is effective to suppress the fluctuation of rotational torque caused by a change of the magnetic attraction force generated by the induction conductor and each permanent magnet. Further, it is possible to adopt an arrangement in which permanent magnets of the same size are arranged at variable intervals. These arrangement patterns can be appropriately combined with each other.

Figure 12A:
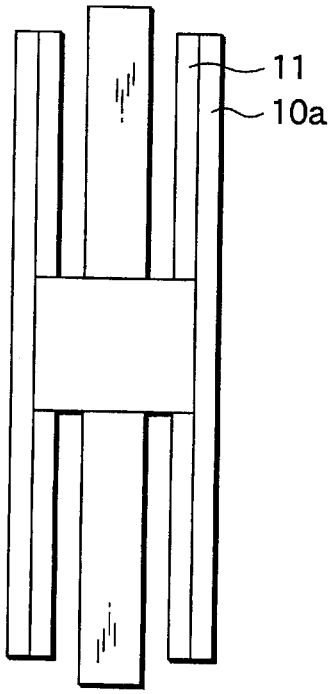
FIGS. 12A and 12B are schematic illustrations for explaining another variation of the structure of permanent magnets of the motion converting section used for the arrangement shown in FIGS. 1A and 1B.
Figure 12B:
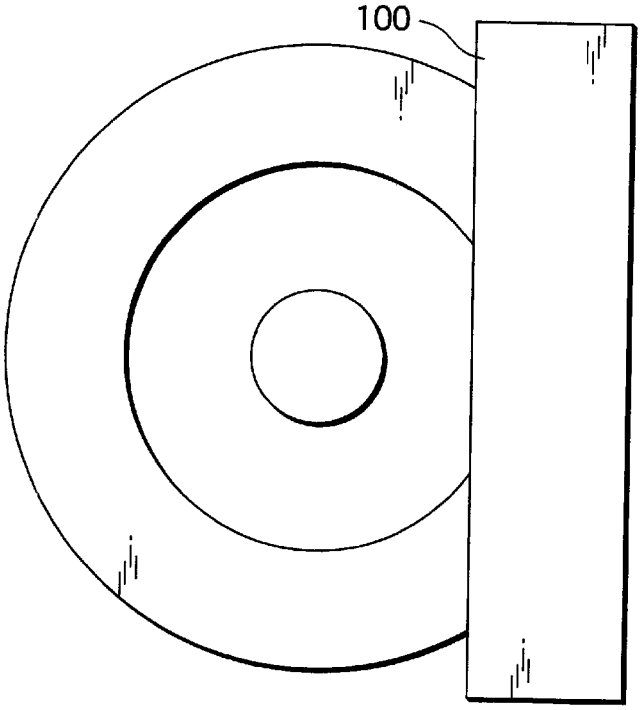

Further, as shown in FIGS. 12A and 12B, it is possible to adopt an arrangement in which hollow disc-shaped permanent magnets, which are magnetized in the thickness direction, are used and the rotational shaft composes a portion of the back yoke.

Figure 13:
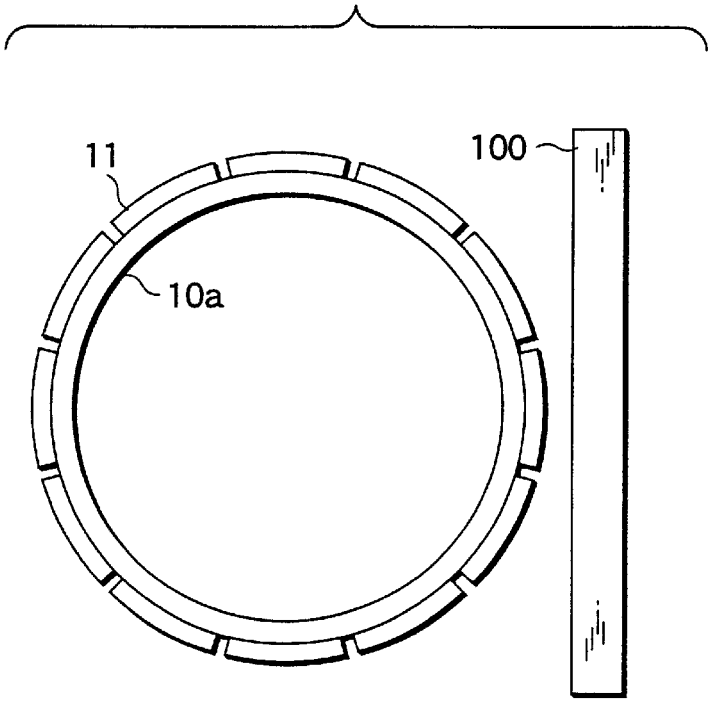
FIG. 13 is a schematic illustration for explaining still another variation of the arrangement of permanent magnets of the motion converting section used for the arrangement shown in FIGS. 1A and 1B.

Furthermore, as shown in FIG. 13, instead of the disc type back yoke, the cylindrical back yoke is used, and permanent magnets are arranged on the outer circumferential face.

Embodiment 2

Figure 14A:
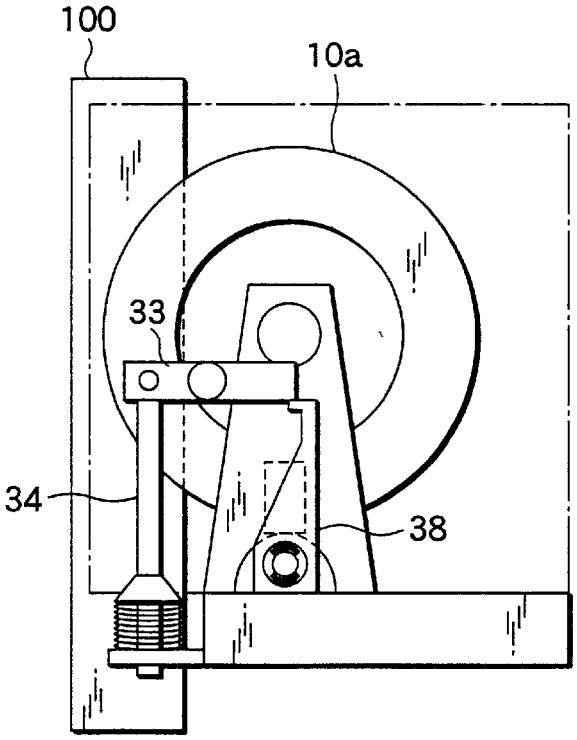
FIGS. 14A and 14B represent a front view and a side view of an elevator speed governor of the second embodiment of the present invention, respectively.
Figure 14B:
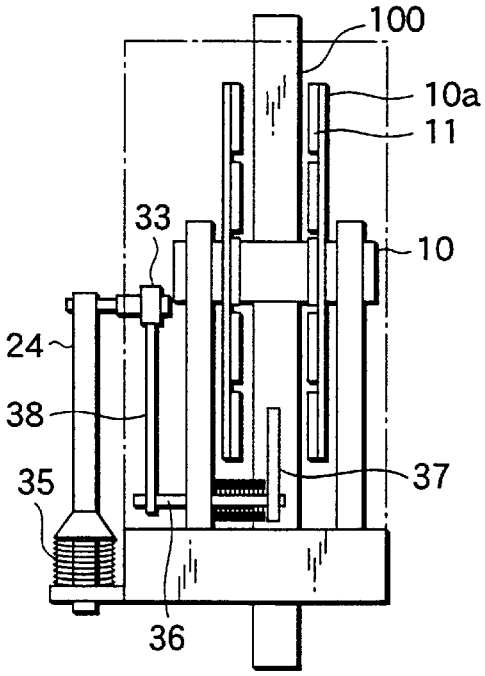

FIGS. 14A and 14B represent a front view and a side view of an elevator speed governor which is the second embodiment of the present invention. The structure of the motion converting section of this elevator speed governor is the same as that of the motion converting section of the elevator speed governor of the first embodiment.

The overspeed sensing section includes: a drive lever 37 made of a ferromagnetic body vertically arranged between a pair of disc type back yokes 10*a* composing the motion converting section fixed to one end of the shaft 36 pivotally supported by the base 1; and a trip lever 38 fixed to the other end of the shaft 36. The drive lever 37 is oscillated together with the trip lever 38 by an alternate force generated by the interaction of the magnetic attraction force, which is caused by the permanent magnet 11 fixed to the disc type back yoke 10*a* by the rotation of the motion converting section caused by the elevation of the cage and also generated by the eddy current created in the drive lever 37.

The overspeed detecting section is composed in such a manner that the cam 32 in the elevator speed governor of the first embodiment of the present invention is replaced by the trip lever 38. When the amplitude of the oscillation of the trip lever 38 exceeds a predetermined value, the trip lever 38 and the connecting lever 33 are disengaged from each other, and the connecting rod 34 is raised, so that the emergency stop device can be stopped.

According to the second embodiment of the present invention, no fly-weight is provided in the rotational section. Therefore, it is unnecessary to use a mechanism rotating integrally with the motion converting section for the overspeed sensing section. Accordingly, moment of inertia of the rotational section can be reduced, and the overspeed sensing section can quickly follow a change in the cage speed.

Figure 15:
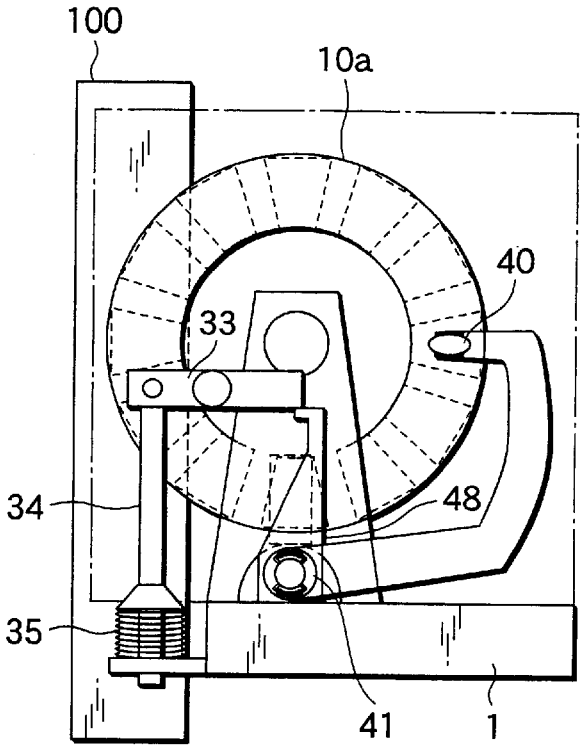
FIG. 15 is a schematic illustration showing a variation of the overspeed sensing section used for the arrangement shown in FIG. 15.
Figure 16:
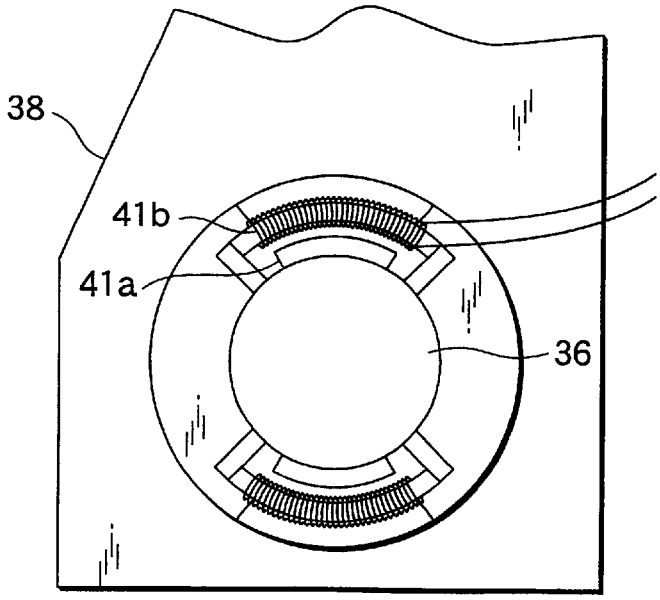
FIG. 16 is a partially enlarged view of the drive actuator shown in the arrangement of FIG. 15.

In this connection, in order to oscillate the trip lever 38 without using the drive lever 37, it is possible to adopt an arrangement in which the trip lever 38 is oscillated by AC power generated in the induction coil 40 arranged in a portion in which the magnetic field is changed in the same manner as that of a place at which the drive lever 37 is attached. FIG. 15 is a front view of an elevator speed governor composed as described above. FIG. 16 is a partially enlarged view of the drive actuator 41 for oscillating the trip lever 38. The drive actuator 41 is composed in the same manner as that according to the motion principle of a boss coil type linear motor. In the upper and the lower portion of the shaft 36, there is provided a magnetic circuit including the permanent magnet 41*a*. In this magnetic circuit, there is provided a drive coil 41*b*, which is connected with the trip lever 38.

Even in this arrangement, it is unnecessary to provide a fly-weight in the rotational section. Therefore, the mechanism can be made simple and moment of inertia can be reduced. In the same manner as that of the first embodiment, when the cage speed is detected, it is unnecessary to press the roller against the guide rail arranged in the hoistway. Accordingly, there is no possibility of the occurrence of abrasion. Therefore, moment of inertia of the rotational section can be reduced, and the overspeed sensing section can quickly follow a change in the cage speed. Further, the device can be highly reliably operated over a long period of time.

Figure 17:
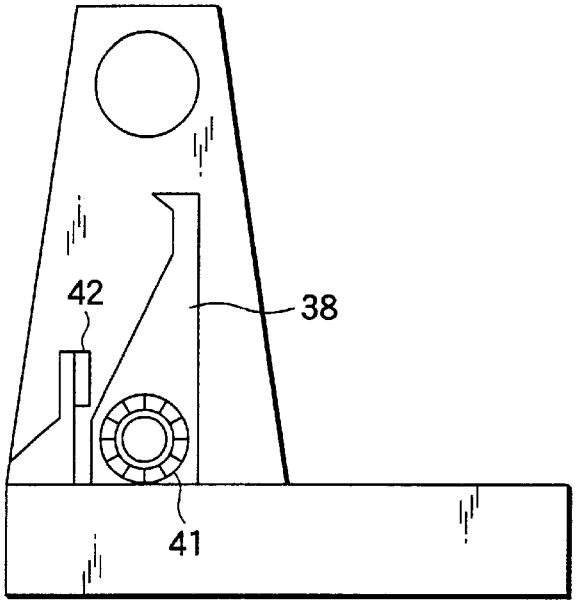
FIG. 17 is a schematic illustration showing a method of compensating temperature dependency of a permanent magnet characteristic according to the present invention.
Figure 18:
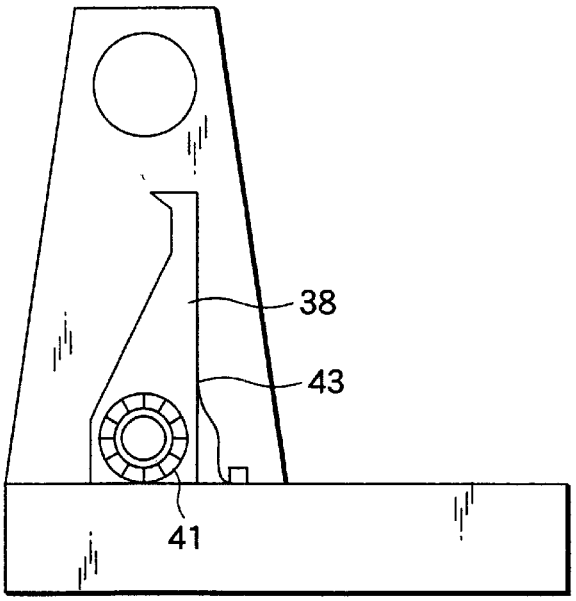
FIG. 18 is a schematic illustration showing another method of compensating temperature dependency of a permanent magnet characteristic according to the present invention.

When temperature dependency of the characteristic of the permanent magnet is compensated, accuracy of the detection of the overspeed of the cage can be enhanced, and reliability of the elevator speed governor can be enhanced. FIGS. 17 and 18 are views respectively showing a specific method by which temperature dependency of the characteristic of the permanent magnet is compensated. In the arrangement shown in FIG. 17, there is provided a permanent magnet 42, which is used for giving a pre-load, in the oscillating section. In this structure, a pre-load is given to the trip lever 38 by an attraction force of the permanent magnet 42 used for giving a pre-load. Since the characteristic of the attraction force generated by the permanent magnet 42 for giving a pre-load is changed by a temperature, it possible to compensate a deterioration of the accuracy to detect the overspeed of the cage. In the arrangement shown in FIG. 18, the oscillating section is supported by the pre-load spring 43 made of bimetal, the displacement of which is changed according to a change in the temperature.

In the arrangement shown in FIG. 15, AC power generated in the induction coil 40 may be supplied to the drive actuator 41 via the electric circuit to realize the compensation of temperature dependency.

Embodiment 3

Figure 19:
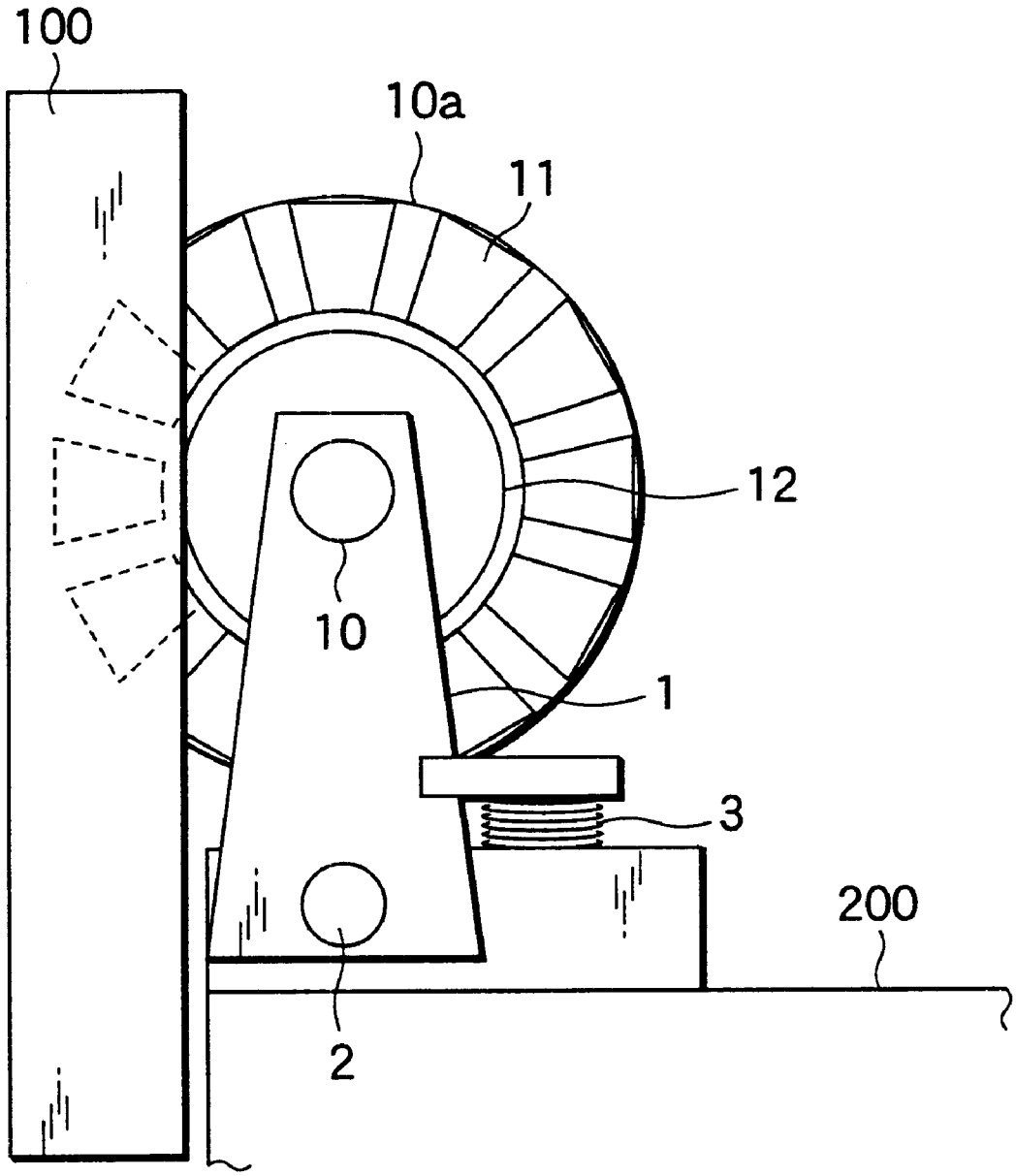
FIG. 19 is a front view of an elevator speed governor of the third embodiment of the present invention.

FIG. 19 is a front view showing a motion converting section for an elevator speed governor which is the third embodiment of the present invention. The motion converting section for the elevator speed governor of this embodiment is composed in such a manner that the roller 12 made of elastic material such as rubber, which is pressed against the induction conductor 100 formed integrally with the disc type back yoke 10*a*, is added to the motion converting section of the elevator speed governor of the first embodiment of the present invention. In this arrangement, the motion converting section is driven by not only the drive according to the principle of rotation of Arago's Rotating Disc but also a frictional force created between the roller and the induction conductor. The roller 12 is pressed against the induction conductor in such a manner that the base 1 is supported by the base shaft 2 so that the base 1 can be rotated relatively with the cage 200, and the base 1 is given a rotational force by the presser spring 3.

According to the above arrangement, even if uniformity of the electromagnetic characteristic can not be guaranteed or a bent portion or step portion exists in the hoistway, the drive force can be created all over the hoistway. Therefore, the elevator speed governor can be stably operated.

The present invention provides an elevator speed governor comprising: a motion converting section for converting a traveling speed of a traveling section of an elevator into a rotational speed, the motion converting section being mounted on the traveling section of the elevator; an overspeed sensing section for sensing a rotational speed not less than a predetermined speed of the motion converting section; and an overspeed detecting section for detecting an overspeed of the traveling section so as to stop the traveling section, wherein the motion converting section includes permanent magnets supported by a rotational shaft of the motion converting section so that the magnets can be rotated integrally with the rotational shaft, and an eddy current is generated according to the traveling speed in an electric induction conductor, which is arranged in a traveling direction of the traveling section of the elevator, by an action of electromagnetic induction caused by the magnetic flux of the permanent magnets, so that a rotational torque is generated in the rotational shaft by the interaction between the eddy current and the magnetic flux. Therefore, no abrasion is caused in the device, and a highly reliable operation can be performed over a long period of time.

The induction conductor is a guide rail arranged in the traveling passage. Accordingly, it is unnecessary to provide a special auxiliary device in the running passage. Therefore, it is possible to realize an economical elevator speed governor.

The overspeed sensing section includes a fly-weight rotated integrally with the rotational shaft and displaced relatively to the rotational shaft by centrifugal forces created by the rotation of the rotational shaft. Therefore, it is possible to realize an elevator speed governor capable of positively detecting an overspeed.

The fly-weight supports the permanent magnets and composes a portion of the motion converting section. Therefore, moment of inertia of the rotational section can be reduced and the governor can quickly follow a change in the cage speed.

The overspeed sensing section includes an oscillator sensing a change of a spatial distribution of the magnetic flux caused by the rotation of the motion converting section and oscillating by an amplitude according to the rotational speed. Therefore, the structure of the overspeed sensing section can be simplified.

The overspeed sensing section includes a power generating section for sensing a change of a spatial distribution of the magnetic flux caused by the rotation of the motion converting section and generating electric power according to the rotational speed. Therefore, the structure of the overspeed sensing section can be simplified.

The motion converting section includes a roller coming into contact with a guide rail arranged in the traveling passage and rotating according to the traveling speed. Therefore, it is possible to realize an elevator speed governor capable of positively detecting the speed of the cage.

What is claimed is:

1. An elevator speed governor comprising:

motion converting means for converting a traveling speed of a traveling section of an elevator into a rotational speed, the motion converting means being mounted on the traveling section of the elevator;

overspeed sensing means for sensing a rotational speed from the motion connecting means not less than a threshold speed; and overspeed detecting means for detecting an overspeed of the traveling section for stopping the traveling section, wherein the motion converting means includes permanent magnets supported by a rotating shaft of the motion converting means so that the magnets are rotated with the rotating shaft, and an eddy current is generated according to traveling speed of the elevator in an electric induction conductor arranged in a traveling direction of the traveling section of the elevator, so that a rotational torque is generated in the rotating shaft by interaction between the eddy current and magnetic flux produced by the permanent magnets.

2. The elevator speed governor according to claim 1, wherein the induction conductor is a guide rail arranged in a traveling passage of the elevator.

3. The elevator speed governor according to claim 1, wherein the overspeed sensing means includes a fly-weight rotated with the rotating shaft and displaced relative to the rotational shaft by centrifugal forces created by the rotation of the rotating shaft.

4. The elevator speed governor according to claim 3, wherein the fly-weight supports the permanent magnets.

5. The elevator speed governor according to claim 1, wherein the overspeed sensing means includes an oscillator sensing a change of a spatial distribution of the magnetic flux caused by the rotational speed and oscillating in an amplitude according to the rotational speed.

6. The elevator speed governor according to claim 1, wherein the overspeed sensing means includes a power generating means for sensing a change of spatial distribution of the magnetic flux caused by the rotational speed and generating electrical power according to the rotational speed.

7. The elevator speed governor according to claim 1, wherein the motion converting means includes a roller contacting a guide rail located in a traveling passage of the elevator and rotating according to the traveling speed.

8. An elevator speed governor comprising:

a motion converting section for converting a traveling speed of a traveling section of an elevator into a rotational speed, the motion converting means being mounted on the traveling section of the elevator;

an overspeed sensing section for sensing a rotational speed from the motion connecting means not less than a threshold speed; and an overspeed detecting section for detecting an overspeed of the traveling section for stopping the traveling section, wherein the motion converting section includes permanent magnets supported by a rotating shaft of the motion converting section so that the magnets are rotated with the rotating shaft, and an eddy current is generated according to traveling speed of the elevator in an electric induction conductor arranged in a traveling direction of the traveling section of the elevator, so that a rotational torque is generated in the rotating shaft by interaction between the eddy current and magnetic flux produced by the permanent magnets.

9. The elevator speed governor according to claim 1, wherein the induction conductor is a guide rail arranged in a traveling passage of the elevator.

10. The elevator speed governor according to claim 1, wherein the overspeed sensing section includes a fly-weight rotated with the rotating shaft and displaced relative to the rotational shaft by centrifugal forces created by the rotation of the rotating shaft.

11. The elevator speed governor according to claim 3, wherein the fly-weight supports the permanent magnets.

12. The elevator speed governor according to claim 1, wherein the overspeed sensing section includes an oscillator sensing a change of a spatial distribution of the magnetic flux caused by the rotation speed and oscillating in an amplitude according to the rotational speed.

13. The elevator speed governor according to claim 1, wherein the overspeed sensing section includes a power generating section for sensing a change of a spatial distribution of the magnetic flux caused by the rotational speed and generating electric power according to the rotational speed.

14. The elevator speed governor according to claim 1, wherein the motion converting section includes a roller contacting a guide rail located in a traveling passage of the elevator and rotating according to the traveling speed.

* * * * *